US007200953B2

(12) United States Patent
Sonner et al.

(10) Patent No.: US 7,200,953 B2
(45) Date of Patent: Apr. 10, 2007

(54) APPARATUS FOR TREATING ARTICLES WITH AT LEAST ONE TEMPERED, DIRECTED AIR JET

(75) Inventors: Harald Sonner, Sindelfingen (DE); Ewald Hornisch, Boeblingen (DE); Achim Vogt, Neustetten (DE); Rainer Benzinger, Boeblingen (DE)

(73) Assignee: Eisenmann Maschinenbau GmbH & Co. KG (DE)

( * ) Notice: Subject to any disclaimer, the term of this patent is extended or adjusted under 35 U.S.C. 154(b) by 0 days.

(21) Appl. No.: 11/032,919

(22) Filed: Jan. 11, 2005

(65) Prior Publication Data

US 2005/0155253 A1 Jul. 21, 2005

(30) Foreign Application Priority Data

Jan. 12, 2004 (DE) ..... 10 2004 001 628

(51) Int. Cl.
*F26B 25/06* (2006.01)

(52) U.S. Cl. ..... 34/225; 34/270; 34/666; 34/417

(58) Field of Classification Search ..... 34/202, 34/224, 225, 229, 270, 272, 417, 428, 429, 34/443, 541, 83, 84, 641, 201, 666
See application file for complete search history.

(56) References Cited

U.S. PATENT DOCUMENTS

| | | | | |
|---|---|---|---|---|
| 4,019,409 | A * | 4/1977 | McKeever | 81/9.51 |
| 5,456,023 | A * | 10/1995 | Farnan | 34/270 |
| 6,192,604 | B1 * | 2/2001 | Morrison | 34/666 |
| 6,735,884 | B2 * | 5/2004 | Fratello et al. | 34/487 |

FOREIGN PATENT DOCUMENTS

DE 101 25 771 C 1 11/2002

* cited by examiner

*Primary Examiner*—Kenneth Rinehart
(74) *Attorney, Agent, or Firm*—Young Basile

(57) ABSTRACT

An apparatus for treating articles, in particular vehicle bodies, with at least one tempered, directed air jet comprises a housing, in which are formed a treatment chamber and at least one pressure chamber, which is separated from the treatment chamber by a partition wall. The tempered air is suppliable to the pressure chamber and may then flow as a directed air jet into the treatment chamber through a nozzle device, which penetrates an opening of the partition wall. The nozzle device is insertable from the treatment chamber into the partition wall and fastenable from the treatment chamber to the partition wall. Consequently, subsequent work on the nozzle device, in particular an exchange thereof, may be carried out more easily.

7 Claims, 5 Drawing Sheets

APPARATUS FOR TREATING ARTICLES WITH AT LEAST ONE TEMPERED, DIRECTED AIR JET

The invention relates to an apparatus for treating articles with at least one tempered, directed air jet, comprising a) a housing;

b) a treatment chamber for the articles, which is formed in the housing;

c) at least one pressure chamber, which is formed in the housing and to which tempered air is suppliable under pressure and which is separated by a partition wall from the treatment chamber;

d) at least one nozzle device, which penetrates an opening of the partition wall and is fastened detachably to the partition wall.

Here, by the term "temper" is meant the heating or cooling of air to a value specified by the process, while keeping within defined limits.

Such apparatuses are commercially known e.g. in the form of drying apparatuses, hereinafter referred to as "driers", in which freshly enamelled or otherwise coated vehicle bodies are dried, during which operation the solvent is stripped from the coating material and/or the coating material is hardened. Of a similar design are cooling apparatuses, also referred to as "cooling zones", which are often disposed downstream of such driers and differ from driers substantially only in the temperature of the air directed towards the vehicle body.

In the case of both driers and cooling apparatuses, it is necessary to be able to set and/or vary the direction of the air jet as well as the air quantity per unit of time that is carried by the air jet. Upon a change of the article to be treated, it is necessary to gain access to the nozzle devices in order, for example, to exchange a nozzle device for one that allows a different volume rate of flow, or alternatively to completely close the opening that was previously penetrated by a nozzle device.

In the known apparatuses of the initially described type, the nozzle devices are introduced through the partition wall from the pressure chamber side and generally screw-fastened to the partition wall at the side facing the pressure chamber. This makes it possible for the side of the partition wall facing the treatment chamber to be kept smooth and free of irregularities, which because of their dirt-accumulating effect are particularly to be avoided when enamelling articles. With this arrangement, however, the nozzle devices are difficult to access, particularly in situations where filters for purifying the air flowing through are additionally situated in the pressure chamber.

SUMMARY OF THE INVENTION

The object of the present invention is to develop an apparatus of the initially described type in such a way that the nozzle device is easier to disassemble and optionally exchange for a different nozzle device.

This object is achieved according to the invention in that the nozzle device is insertable from the treatment chamber into the partition wall and fastenable from the treatment chamber to the partition wall.

In the treatment chamber there is generally enough room available to allow maintenance personnel to approach the nozzle that is to be exchanged and carry out the necessary work without difficulty. The present invention at the same time overcomes the prejudice that fastening means, by which the nozzle device may be fastened from the treatment chamber to the partition wall, necessarily lead to such irregularities of the side of the partition wall facing the treatment chamber that dirt accumulates here.

In an advantageous form of construction of the apparatus according to the invention, the nozzle device has a flange, which in the assembled position lies against the side of the partition wall facing the treatment chamber. This flange precisely defines the depth of insertion of the nozzle device into the partition wall. The flange may be kept thin enough to prevent a significant step at the side of the partition wall facing the treatment chamber.

The nozzle device is advantageously fastenable to the partition wall by means of a bayonet-catch-like fastening device. This type of fastening device has the advantage that all of the fastening components that have a greater thickness may be disposed, viewed from the treatment chamber, not in front of but behind the partition wall. They therefore do not disrupt the smoothness of the side of the partition wall facing the treatment chamber.

In particular, in said case a development is conceivable, in which the fastening device comprises a fastening ring, which is provided on the nozzle device and has at least one radially outwardly projecting detent lug, wherein the opening of the partition wall has an insertion opening, which widens the opening in radial direction and is so dimensioned that the detent lug is passed through the insertion opening and then by virtue of a rotation of the fastening ring is appliable against the side of the partition wall remote from the treatment chamber. The detent lug, which has substantially to take up the fastening forces, may be equipped with the thickness required for this purpose without there being any risk of this causing dirt to accumulate at the side of the partition wall facing the treatment chamber.

When the detent lug in at least one end region pointing in azimuthal direction is bent at an angle away from the partition wall, the detent lug is easier to rotate to a point behind the partition wall during the closing motion.

Particularly preferred is the form of construction of the apparatus according to the invention, in which the detent lug is made of resilient material. The opening of the partition wall may in said case be widened in radial direction by means of a detent opening, which is so dimensioned that the detent lug may partially enter it but not pass through it. The detent lugs therefore take over a second function besides that of being part of the bayonet-catch-like fastening device. By virtue of their partial "engagement" into the detent opening additionally provided in the partition wall, they ensure a defined closed position, from which there is no longer any unintended release. A rotation with simultaneous expenditure of a specific amount of force, on the other hand, allows the detent connection to be released and the detent lug to be brought back under the insertion opening in the partition wall. The entire nozzle device may then be pulled in axial direction out of the opening of the partition wall.

Release of the detent lugs from the detent position in the detent recess is facilitated when the detent lug in the manner described above has at least one end region bent at an angle.

For the sake of stability, it is recommended that a plurality of detent lugs be distributed over the circumference of the fastening ring and that a plurality of insertion openings be distributed over the circumference of the opening of the partition wall.

In a corresponding manner, it is advantageous when a plurality of detent openings are distributed over the circumference of the opening of the partition wall.

In an advantageous form of construction of the invention, the fastening ring is fastened to the flange.

Often, the articles to be treated are to be acted upon at various sides by directed tempered air. The form of construction of the apparatus according to the invention is then recommended, in which on opposite sides of the treatment chamber in each case a pressure chamber is provided, which is separated from the treatment chamber by a partition wall containing at least one nozzle device.

The apparatus is preferentially a drier or a cooling apparatus.

The article to be treated is preferentially a vehicle body, for which the advantages described above are particularly beneficial.

BRIEF DESCRIPTION OF THE DRAWINGS

There now follows a detailed description of an embodiment of the invention with reference to the drawings; the drawings show.

DETAILED DESCRIPTION OF THE PREFERRED EMBODIMENT

Figure 1:
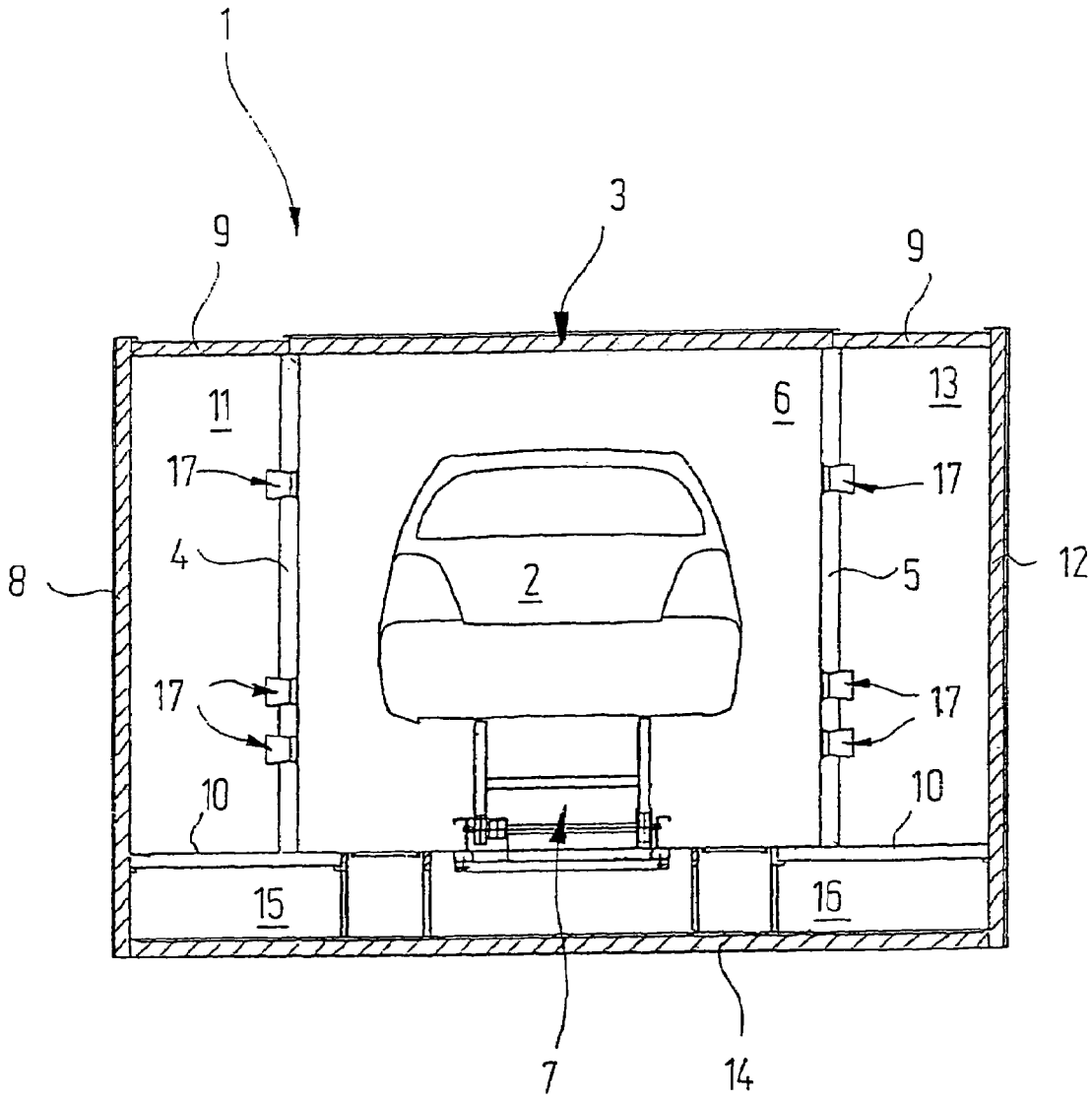
FIG. 1 a vertical section through a drier for vehicle bodies.

FIG. 1 shows a diagrammatic vertical section through a drier 1, which is intended for drying freshly enamelled vehicle bodies 2. The drier I in a known manner has a housing 3, in which a drier tunnel 6, i.e. a treatment chamber, is formed and laterally delimited by two inner partition walls 4, 5. The vehicle bodies 2 are conveyed at right angles to the drawing plane of FIG. 1 continuously or discontinuously through the drier 1 with the aid of a conveying system 7, which is of no further interest here.

The, in FIG. 1, left side wall 8 and the top 9 of the housing 3 as well as a partition wall 10 extending horizontally in the bottom region of the housing 3 jointly with the, in FIG. 1, left partition wall 4 delimit a first pressure chamber 11. In a similar manner the, in FIG. 1, right side wall 12, the top 9 of the housing 3 as well as the horizontal partition wall 10 jointly with the, in FIG. 1, right vertical partition wall 5 delimit a second pressure chamber 13. The pressure chambers 11 and 13 are accessible to personnel through non-illustrated doors and connected in each case to a source of conditioned, pressurized and heated air (not shown).

The horizontal partition wall 10 is interrupted in the region of the conveying system 7; said partition wall jointly with the underside 14 of the housing 3 delimits on either side of the conveying system 7 an extraction channel 15 and/or 16.

The pressure chambers 11 and 13 are connected to the drier tunnel 6 in each case by a plurality of nozzle devices 17, which extend through openings 22 in the corresponding partition wall 4 and/or 5. These nozzle devices 17 are all of substantially the same construction but may differ in their effective flow cross section.

Figure 4:
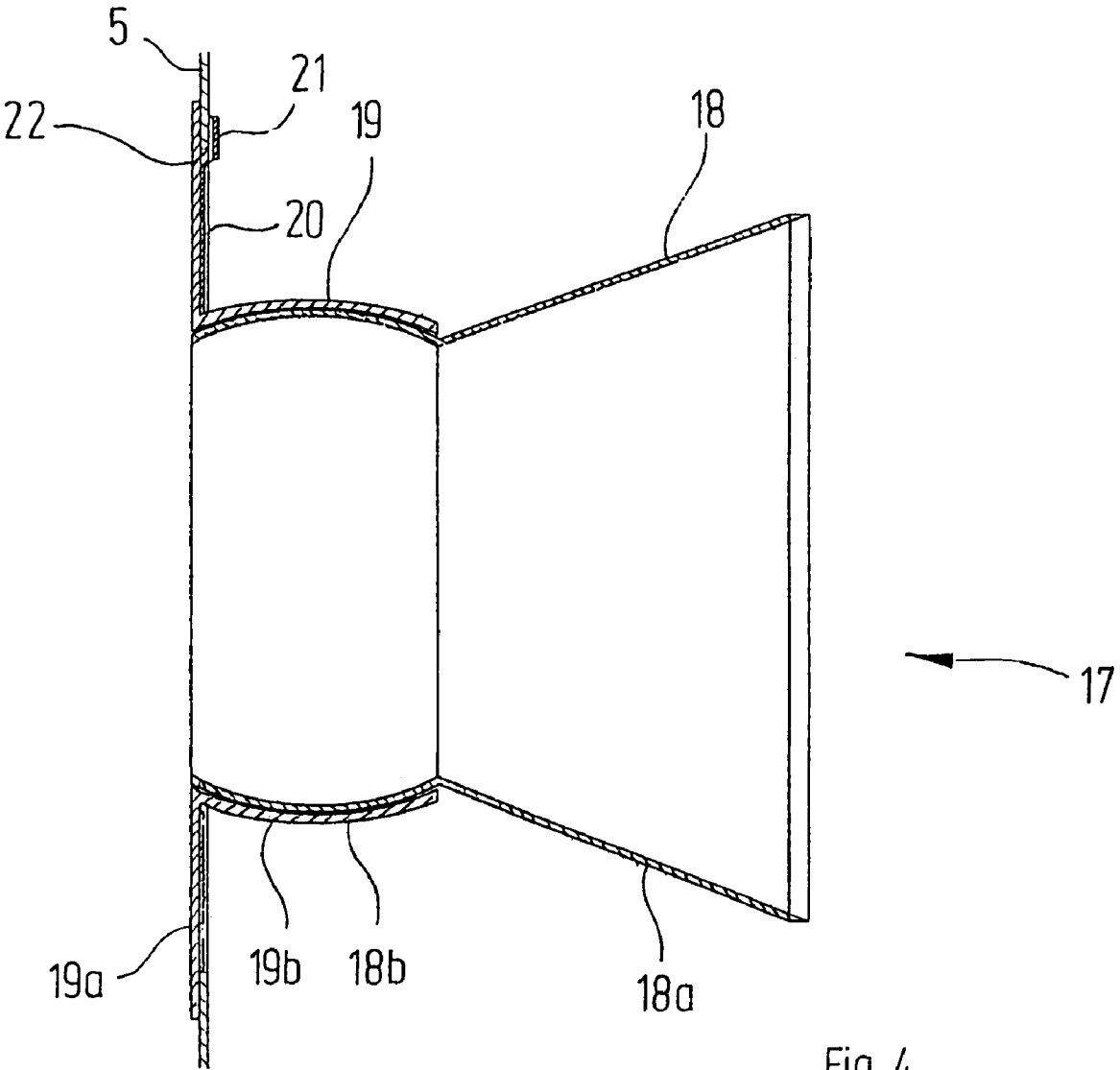
FIG. 4 an enlarged section through one of the nozzle devices of FIG. 3.
Figure 5:
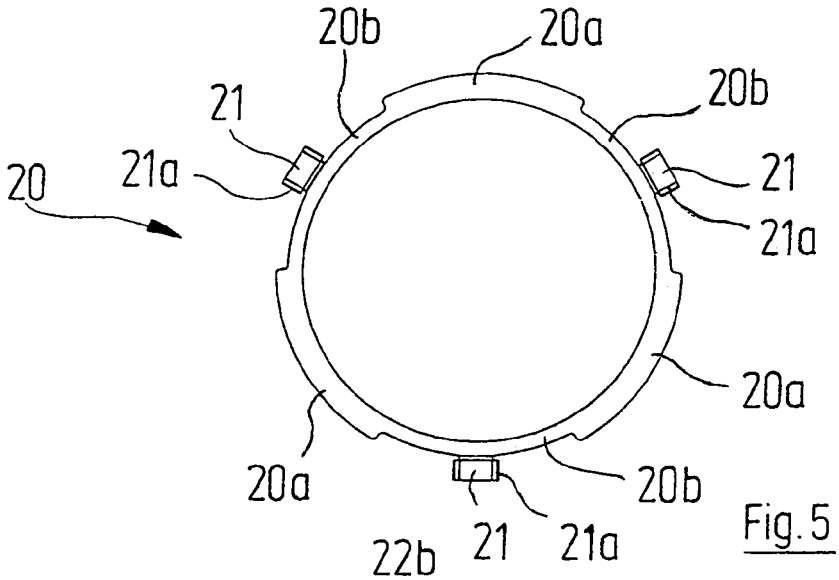
FIG. 5 the plan view of a fastening ring of the nozzle device of FIG. 4.
Figure 7:
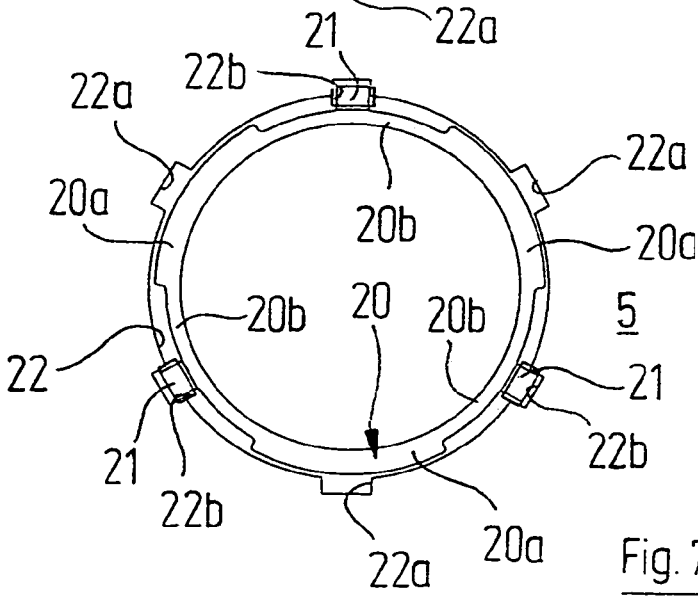
FIG. 7 a diagrammatic view of the fastening ring of FIG. 5, inserted and latched into the through-opening of FIG. 6.

The exact style of construction of the nozzle devices 17 is evident in particular from FIGS. 4, 5 and 7, to which reference is now made. Each nozzle device 17 comprises an air-swept nozzle body 18, which comprises a conically extending portion 18*a* and a spherical cup-shaped portion 18*b* attached thereto. A receiver 19 of the nozzle device 17 likewise has a spherical cup-shaped portion 19b, which embraces the spherical cup-shaped portion 18*b* of the nozzle body 18 in such a way that the nozzle body 18 may be swivelled under the guidance of the receiver 19. The spherical cup-shaped portion 19*b* of the receiver 19 is connected to a flange 19*a*, which extends radially in relation to the axis of the receiver 19.

Figure 8:
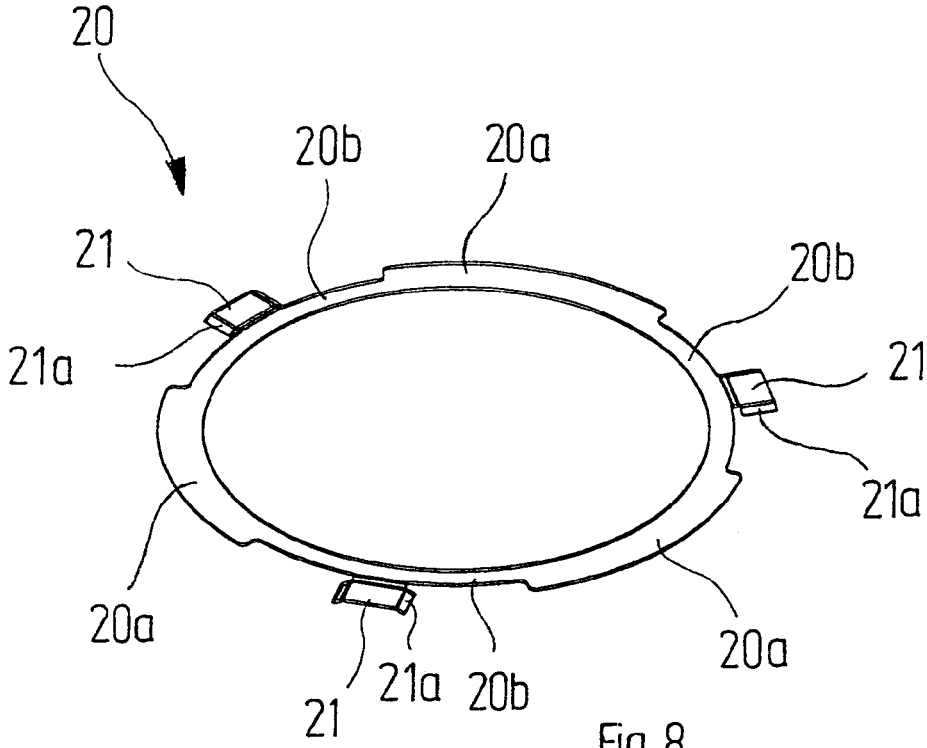
FIG. 8 a perspective view of the fastening ring of FIG. 5.

Fastened to the flange 19*a* of the receiver 19 at its annular end face facing the spherical cup-shaped portion 19*b* is a fastening ring 20, which is illustrated in detail in particular in FIGS. 5 and 8. The fastening ring 20 has the same inside diameter throughout but is subdivided by corresponding increases of the outside diameter into, in each case, three wider portions 20*a*, which are at an angular distance of 120° from one another, and three narrower portions 20*b* situated between the wider portions 20*a*. The wider portions 20*a* are used to fix the fastening ring 20 to the flange 19*a*, preferably by glueing.

Each narrower portion 20*b* of the fastening ring 20 carries a radially extending fastening lug 21, which in FIG. 8 is offset slightly downwards. The end regions 21*a* of the fastening lugs 21 pointing in peripheral direction are bent round slightly in a downward direction.

Figure 2:
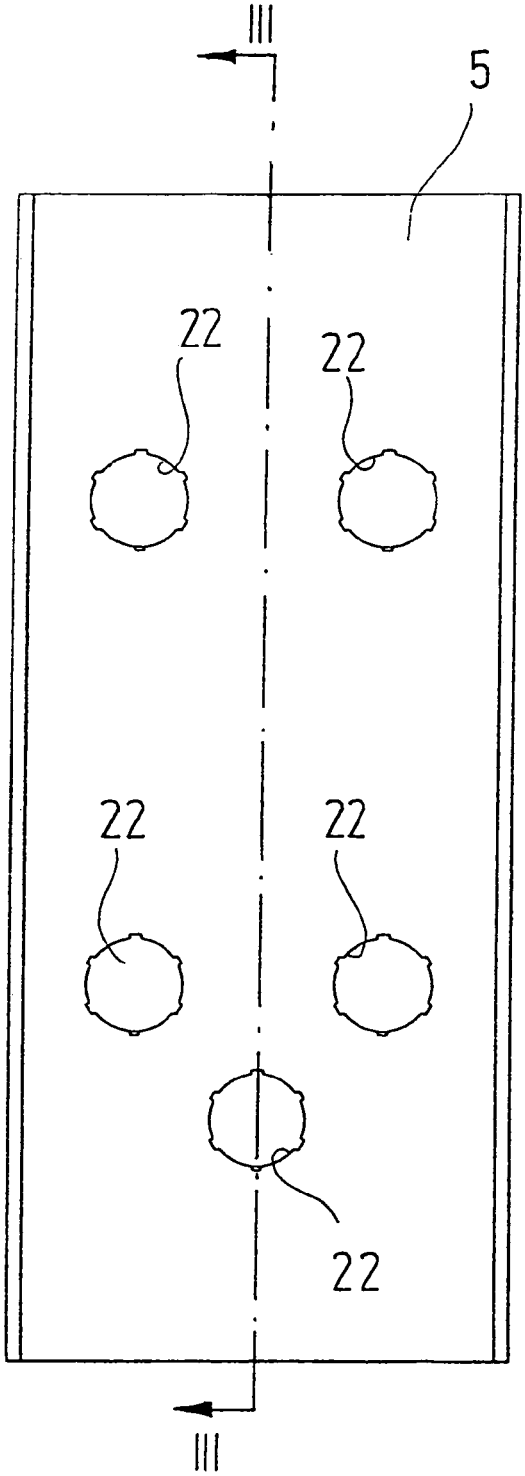
FIG. 2 the plan view of a partition wall, which is provided in the drier of FIG. 1 and from which the nozzle devices have been removed.
Figure 3:
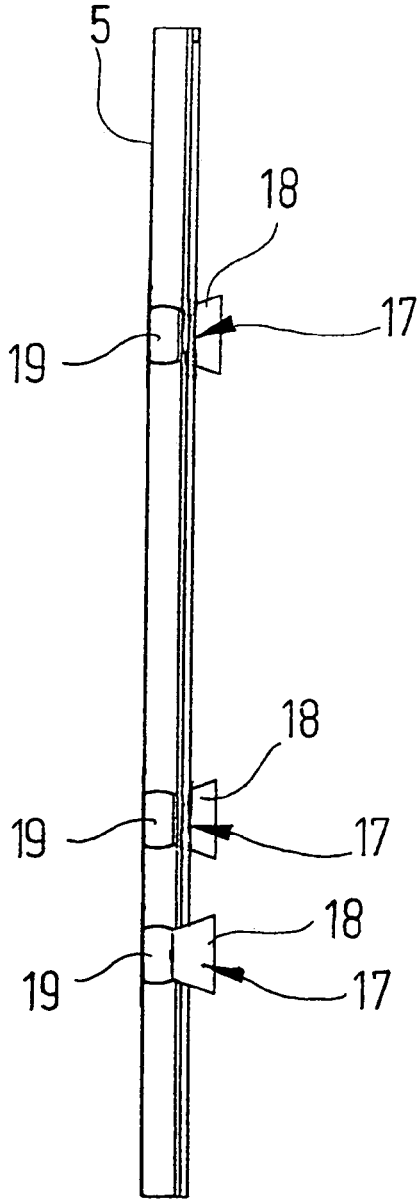
FIG. 3 a section through the partition wall of FIG. 2 according to the line III—III in FIG. 2, but with nozzle devices inserted.
Figure 6:
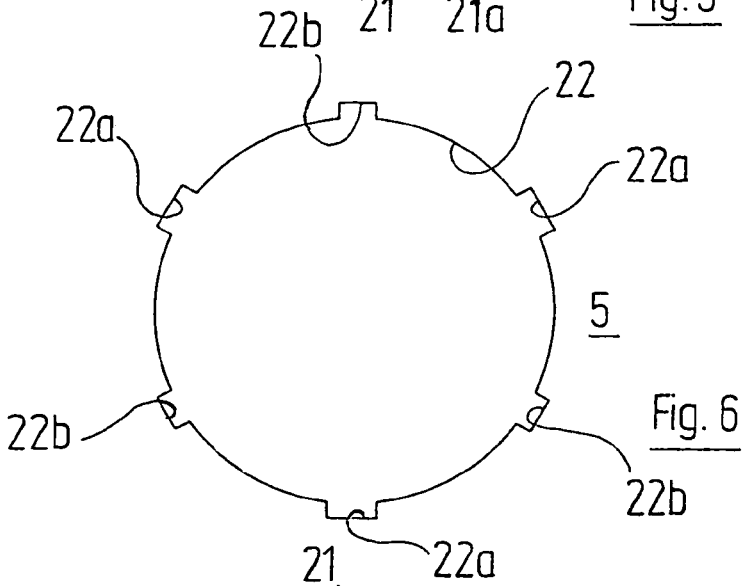
FIG. 6 the enlarged plan view of an opening in the partition wall of FIG. 2.

As FIGS. 2 and 6 in particular reveal, the vertical partition walls 4 and 5 have an opening 22 for each nozzle device 17. The boundary line of each opening 22 has the basic shape of a circle, wherein however at the angular distance of 120° three radially outwardly extending, relatively wide groove-like recesses 22*a* are provided. Situated midway between each two wide groove-like recesses 22*a* is a narrower groove-like recess 22*b*; altogether, there are therefore likewise three narrow groove-like recesses 22*b* situated at an angular distance of 120°. Here, the wider groove-like recesses 22*a* are referred to as "insertion openings" and the narrower groove-like recesses 22*b* as "detent openings". The dimensions of the insertion openings 22*a* are slightly larger than the dimensions of the detent lugs 21 of the fastening ring 20, in particular also in peripheral direction. The dimension of the detent openings 22*b*, on the other hand, is slightly smaller in peripheral direction than the peripheral extension of the detent lugs 21.

The nozzle device 17 is fastenable to the partition walls 4 and 5 in the manner described below with reference to FIGS. 2 to 10 for the partition wall 5.

Figure 9:
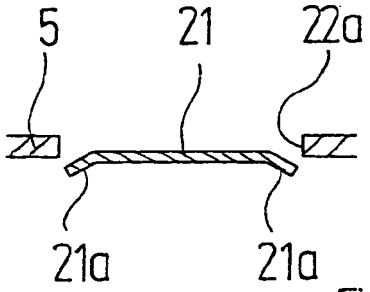
FIG. 9 a diagrammatic view of a detent lug of the fastening ring of FIGS. 5 and 8 immediately after being inserted into the opening of the partition wall.

First, the nozzle body 18 and the receiver 19 are assembled into the complete nozzle device 17. Then, the nozzle device 17 is inserted, conical portion 18*a* of the nozzle body 18 and spherical cup-shaped portion 19*b* of the receiver 19 first, into the corresponding opening 22 of the partition wall 5. This is done from the drier tunnel 6. The angular orientation of the receiver 19 and hence the angular orientation of the fastening ring 20 is in said case selected in such a way that the detent lugs 21 of the fastening ring 20 are aligned in each case with an insertion opening 22*a* of the opening 22. The detent lugs 21 may therefore pass through the insertion openings 22*a*, as is shown in FIG. 9. When the receiver 19 is then rotated inside the opening 22 of the partition wall 5, the detent lugs 21 engage behind the partition wall 5 in regions lying adjacent in peripheral direction to the insertion openings 22*a*. The bent end regions 21*a* of the detent lugs 21 in said case interact with the edges of the insertion openings 22*a* in such a way that the detent lugs 21 are pressed further out of the plane of the fastening ring 20 and may therefore slide behind the partition wall 5.

Figure 10:
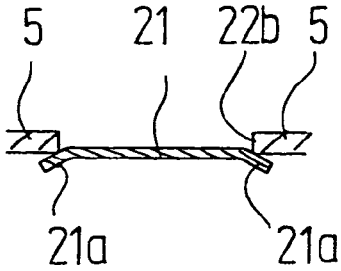
FIG. 10 a view similar to FIG. 9 of the detent lug, latched into the opening of the partition wall.

The rotational movement of the receiver 19 and hence of the fastening ring 20 of the nozzle device 17 is continued until the detent lugs 21 snap into the detent openings 22*b* of the corresponding through-opening 22 in the partition wall 5. This is the assembled position of the nozzle device 17 in the partition wall 5 that is illustrated in FIG. 10.

When the nozzle device 17 is to be removed, the receiver 19 merely has to be rotated in either direction. With the aid of the bent end portions 21*a* the detent lugs 21 are then lifted out of the detent openings 22*b* of the opening 22 in the partition wall 5. The receiver 19 may then be rotated once more until the detent lugs 21 are aligned with the wider insertion openings 22*a*. The entire nozzle device 17 is then removable axially in the direction of the drier tunnel 6.

The angle, at which the nozzle body 18 is situated relative to the receiver 19, may be varied likewise from the drier tunnel 9 by, for example, introducing a rod-shaped tool from there into the interior of the nozzle body 18 and using it as a lever to adjust the desired angle.

The operation of the drier 1 illustrated in FIG. 1 is otherwise conventional: purified, heated and conditioned air is introduced into each of the two pressure chambers 11, 13, flows through the nozzle devices 17 into the drier tunnel 6 and acts there upon the vehicle body 2 that is to be dried. As the heat requirement for vehicle bodies 2 is usually greater in the lower region than in the upper region, a higher number of nozzle devices 17 are provided in the lower region. The local drying effect at the vehicle body 2 may moreover be influenced also by the effective flow cross section of the various nozzle devices 17 as well as by the angular alignment of the nozzle body 18 relative to the receiver 19.

The hot air that has entered the drier tunnel 6 leaves the drier tunnel 6 in a downward direction through the intermediate space between the two lateral portions of the bottom horizontal partition wall 10 and is then removed from the drier 1 through the extraction channels 15, 16 and supplied, for example, to a heating and filtering unit, from where it is returned in a suitably conditioned state to the pressure chambers 11 and 13.

The invention claimed is:

1. An apparatus for treating articles with at least one tempered, directed air jet, comprising:

a housing;

a treatment chamber for the articles, which is formed in the housing;

at least one pressure chamber, which is formed in the housing and to which tempered air is suppliable under pressure and which is separated from the treatment chamber by a partition wall;

at least one nozzle device, which penetrates an opening of the partition wall and is fastened detachably to the partition wall, wherein the nozzle device is insertable from the treatment chamber into the partition wall and fastenable from the treatment chamber to the partition wall;

the nozzle device being fastenable to the partition wall by means of a bayonet-catch fastening device; and the fastening device comprises a fastening ring having a detent lug, which is provided on the nozzle device, and that the opening of the partition wall has an insertion opening, which widens the opening in radial direction and is so dimensioned that the detent lug is passed through the insertion opening and then by virtue of a rotation of the fastening ring is appliable against the side of the partition wall remote from the treatment chamber.

2. Apparatus according to claim 1, characterized in that the detent lug in at least one end region pointing in azimuthal direction is bent at an angle away from the partition wall.

3. Apparatus according to claim 1, characterized in that the detent lug is made of resilient material.

4. Apparatus according to claim 3, characterized in that the opening of the partition wall is widened in radial direction by means of a detent recess, which is so dimensioned that the detent lug may partially enter it but not pass through it.

5. Apparatus according to claim 4, characterized in that a plurality of detent lugs are distributed over the circumference of the fastening ring and a plurality of insertion openings are distributed over the circumference of the opening of the partition wall.

6. Apparatus according to claim 5, characterized in that a plurality of detent openings are distributed over the circumference of the opening of the partition wall.

7. Apparatus according to claim 1, characterized in that the fastening ring is fastened to a flange.

* * * * *